US006755311B2

(12) United States Patent
Berry

(10) Patent No.: US 6,755,311 B2
(45) **Date of Patent: *Jun. 29, 2004**

(54) METHOD AND PORTABLE APPARATUS FOR STORING LONG-HANDLED GARDEN TOOLS PRIOR TO USE IN LANDSCAPING

(76) Inventor: Robert J. Berry, Box 6122, 6801 E. Stagecoach Pass, Carefree, AZ (US) 85377

( * ) Notice: Subject to any disclaimer, the term of this patent is extended or adjusted under 35 U.S.C. 154(b) by 0 days.

This patent is subject to a terminal disclaimer.

(21) Appl. No.: 10/227,467

(22) Filed: Aug. 23, 2002

(65) Prior Publication Data

US 2004/0035808 A1 Feb. 26, 2004

Related U.S. Application Data

(63) Continuation-in-part of application No. 09/939,818, filed on Aug. 28, 2001, now Pat. No. 6,530,487.

(51) Int. Cl.[7] ..... A47F 7/00

(52) U.S. Cl. ..... 211/70.6; 211/65; 248/512; 248/519

(58) Field of Search ..... 211/70.6, 65, 60.1, 211/70, 70.8; 248/512, 513, 519, 346.2

(56) References Cited

U.S. PATENT DOCUMENTS

| | | | | | |
|---|---|---|---|---|---|
| 3,298,532 | A | * | 1/1967 | Wilcke | |
| D232,793 | S | * | 9/1974 | Bennett | |
| 4,947,998 | A | * | 8/1990 | Smeller | 211/70.6 |
| 5,092,463 | A | * | 3/1992 | Dees | 211/70.6 X |
| 5,094,422 | A | * | 3/1992 | Tiffany | 248/519 |
| 5,390,944 | A | * | 2/1995 | Sherwin | 211/70.6 X |
| D372,092 | S | * | 7/1996 | Brown | |
| D382,998 | S | * | 9/1997 | Conigliaro | |
| 5,704,496 | A | * | 1/1998 | Latta | 211/70.6 |
| 6,530,487 | B1 | * | 3/2003 | Berry | 211/70.6 |

* cited by examiner

*Primary Examiner*—Robert W. Gibson, Jr.
(74) *Attorney, Agent, or Firm*—Tod R. Nissle, P.C.

(57) ABSTRACT

A stand stores long-handled garden tools. The tools are removed from the stand to be used. The stand is unusually compact and permits a plurality of garden tools to be stored in close proximity to one another. The distal end of a garden tool is slidably received by a sleeve formed in the stand. The sleeve is shaped to contact the distal end of the tool and maintain the tool in a substantially vertical orientation while permitting the tool to generate a force which forces the stand against the ground.

10 Claims, 10 Drawing Sheets

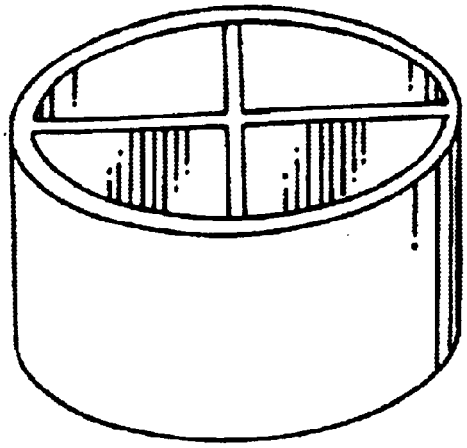
FIG. 1: PRIOR ART
FIG. 2: PRIOR ART
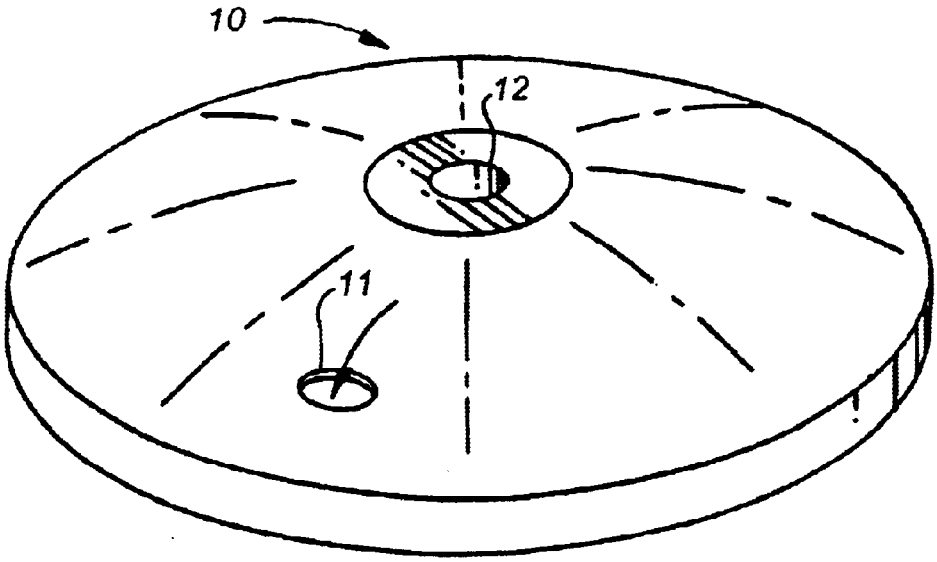

METHOD AND PORTABLE APPARATUS FOR STORING LONG-HANDLED GARDEN TOOLS PRIOR TO USE IN LANDSCAPING

This application is a continuation-in-part of application Ser. No. 09/939,818, filed Aug. 28, 2001, now U.S. Pat. No. 6,530,487.

This invention pertains to a method and apparatus for storing tools.

More particularly, this invention pertains to a method and apparatus for storing, prior to use, long-handled garden tools.

In a further respect, the invention pertains to a portable tool storage apparatus which is readily picked up, handled, and transported by individuals of average strength and dexterity.

In another respect, the invention pertains to a tool storage apparatus which occupies an unusually small space in a residence, but which can still securely hold and store long-handled garden tools.

In still another respect, the invention pertains to a tool storage apparatus which enables tools to be securely stored in close proximity to one another.

In yet another respect, the invention pertains to tool storage apparatus which can, while tools are stored in the apparatus, be lifted while the tools maintain relatively fixed because the tools maintain contact with the ground.

In yet still another respect, the invention pertains to tool storage apparatus which has dimensions in specific desired proportions to the length of long-handled tools to insure that the tools can be securely stored in a receptacle of minimal size which can readily transported.

Receptacles for storing tools are known in the art. The receptacle shown in FIG. 1 ordinarily is used to store many long-handled garden tools by placing the tool handles in the receptacle. Using the receptacle to store only a few long-handled tools is impractical because each tool handle readily slides across the bottom of the receptacle, tilts, and causes the receptacle to tip. The receptacle of FIG. 1 can be made sufficiently large and weighty to prevent tipping when a tool tilts in the receptacle. However, such a construction makes it awkward to transport and move the receptacle.

The hollow receptacle 10 illustrated in FIG. 2 includes a central aperture 12 and an opening 11. Water, sand, or other material is inserted through opening 11 into receptacle 10 as ballast to maintain receptacle 10 in position. Receptacle 10 is not utilized to store tools, but is instead placed under a table. An aperture is formed through the center of the table. The pole of an umbrella is slid through the hole in the table such that the distal end of the pole seats in aperture 12. The umbrella opens to extend over and shade the table. The receptacle 10 is not believed to be relevant prior art simply because it would never reasonably be considered to store a long-handled garden tool. The umbrella normally seated in aperture 12 is used while it is in aperture 12. In contrast, a tool in the receptacle of FIG. 1 is only stored, and is not utilized until it is removed from the receptacle. In addition, the receptacle 10 is impractical because it has a diameter of at least two feet and is, when filled with water or sand, heavy and difficult to move.

Accordingly, it would be highly desirable to provide a method and apparatus for storing long-handled garden tools which would store, prior to their use, a plurality of tools in a configuration which would prevent substantial tilting of the tools, which would utilize a small inconspicuous storage receptacle that can readily be utilized at a variety of locations in a residence, which could store a variety of different tools in close proximity to one another, which would permit ready, practical transport of the tool storage apparatus, which would permit the storage apparatus to be lifted while the stability of the tools in the apparatus is enhanced because the tool handles maintain contact with the ground, and which would permit ready access to and removal of the tools.

Therefore, it is a principal object of the instant invention to provide an improved method and apparatus for storing long-handled garden tools.

These and other, further and more specific objects and advantages of the invention will be apparent from the following detailed description of the invention, taken in conjunction with the drawings, in which:

FIG. 1 is perspective view illustrating a prior art tool storage receptacle;

FIG. 2 is a perspective view illustrating a prior art stand for an umbrella table;

Figure 3:
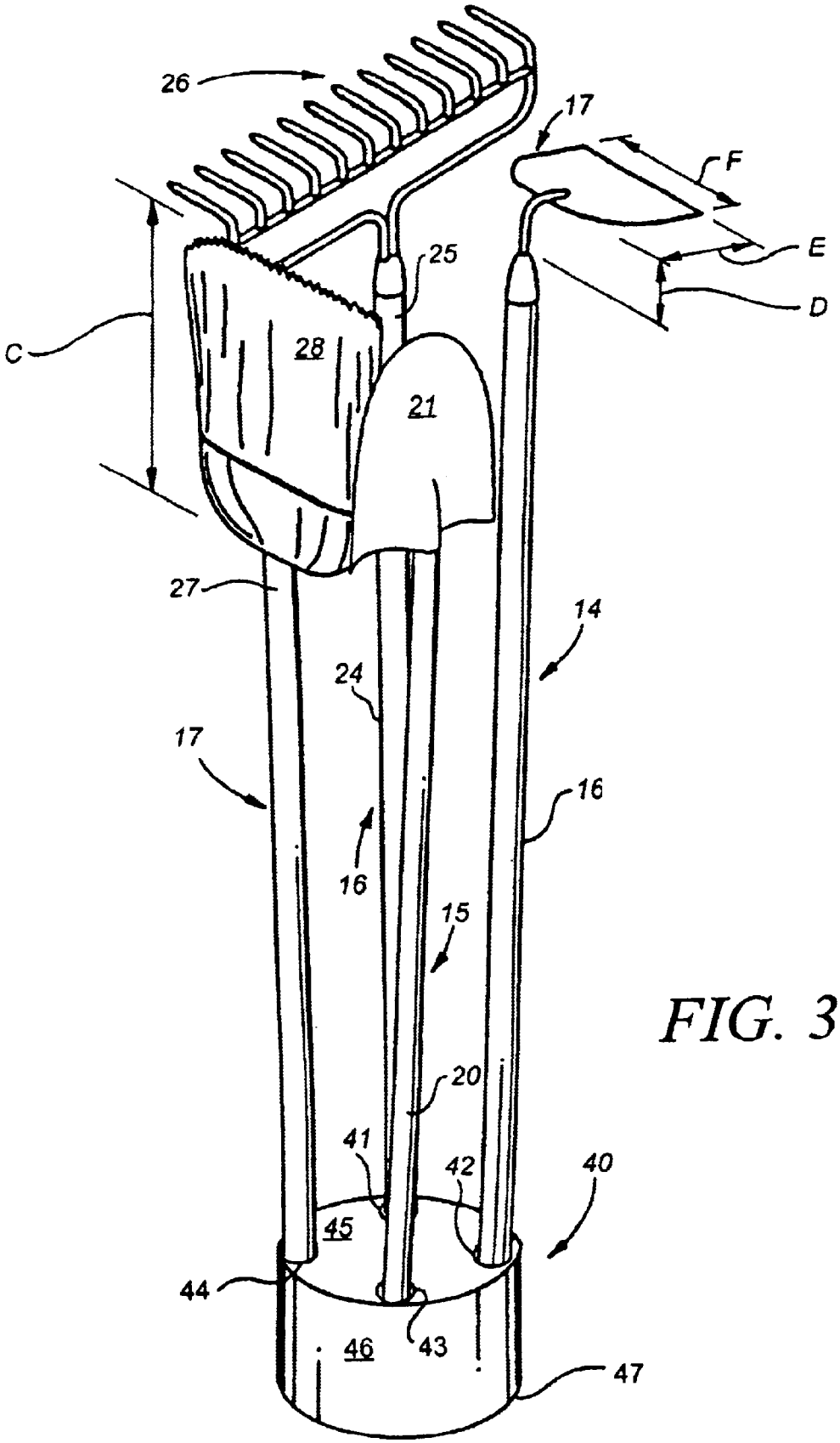
FIG. 3 is a perspective view illustrating a tool storage stand for long-handled garden tools constructed in accordance with the principles of the invention.

Briefly, in accordance with my invention, I provide an improved tool storage receptacle for long-handled garden tools each including a handle with a distal end and a proximate end, and a head connected to the proximate end. The tool storage receptacle includes a bottom ground engaging surface having a center; a hollow circumferential wall extending upwardly from the bottom surface; and, a plurality of hollow sleeves. Each sleeve extends upwardly from the bottom surface; is sized to contact the distal end of the handle and support the tool in an upright orientation spaced apart from the handles of tools in other ones of said sleeves; is outside and adjacent the circumferential wall to increase the structural integrity of the sleeve; is sized to receive the distal end of the handle of a long handled garden tool; is spaced apart from the center; and, is spaced apart from at least one of the other hollow sleeves.

In a further embodiment of the invention, I provide an improved tool storage stand. The tool stand comprises, in combination, a plurality of long-handled garden tools each including a handle having a distal end, and including a proximate end, and a head attached to the proximate end of the handle; a base including a ground engaging bottom surface and a perimeter extending upwardly from the ground engaging bottom surface; and, a plurality of apertures in the base each extending through the base, adjacent the perimeter of the base, and slidably receiving the distal end of the handle of a tool in contact with the ground and supporting the handle in an upright orientation spaced apart from handles of tools in the other ones of the apertures.

In another embodiment of the invention, I provide a method of storing in a residence including outer grounds, and using a plurality of long-handled garden tools each having a handle with a distal end and a proximate end, and a head connected to the proximate end. The method includes the step of providing in a residence a support member having a center, a perimeter, at least a pair of opposing sides spaced apart from and bracketing the center, and at least a pair of vertically oriented apertures each formed in the support member at the perimeter on one of the sides opposite that of the other one of the apertures and shaped and dimensioned to receive and contact the distal end of a handle of a tool in contact with the ground to support and maintain the handle in a substantially vertical orientation spaced apart from handles in the other ones of the apertures; inserting for temporary storage the distal end of the handle of each long-handled garden tool in a support member in a different one of the vertically oriented apertures such that each pair of handles is in a different one of the pair of apertures; and, removing each tool from the support member and using the tool during yard work in the outer grounds of the residence.

In still a further embodiment of the invention, I provide an improved tool storage stand comprising, in combination, a base having a height, a width, and a plurality of apertures each shaped and dimensioned to receive the end of the handle of only one tool and support the handle in an upright orientation spaced apart from handles in the other ones of the apertures; and, a plurality of long-handled garden tools each with a handle having a length and including a distal end and a proximate end, and a head connected to the proximate end, the distal end inserted in and supported by one of the apertures. The ratio of the length of each tool handle to the height of the base is in the range of 22:2 to 11:2.

In still another embodiment of the invention, I provide an improved tool storage receptacle for long-handled garden tools. Each tool includes a handle having a distal end and a proximate end, and includes a head connected to the proximate end. The improved tool storage receptacle includes a bottom ground engaging surface having a center; a circumferential wall extending upwardly from the bottom surface; and, a plurality of hollow sleeves. Each hollow sleeve extends upwardly from the bottom surface; is sized to contact the distal end of and support a long-handled garden tool in an upright orientation spaced apart from the handles of tools in other ones of the sleeves; is outside of and adjacent the circumferential wall to increase the structural integrity of the sleeve; is sized to receive slidably the distal end of a handle of a long-handled garden tool; is spaced apart from the center; and, is spaced apart from and in symmetrical relationship with each of the other hollow sleeves.

In yet a further embodiment of the invention, I provide an improved tool receptacle for long-handled garden tools each inlcuding a handle having a distal end and a proximate end, and includes a head connected to the proximate end. The tool storage receptable comprises a bottom ground engaging surface having a center; a circumferential wall extending upwardly from the bottom surface; and, a plurality of hollow sleeves. Each hollow sleeve extends upward from the bottom surface; is sized to contact the distal end of the handle of a long-handled garden tool and support the tool in an upright orientation spaced apart from the handles of tools in other ones of the sleeves; is outside and adjacent the circumferential wall to increase the structural integrity of the sleeve; is sized to receive slidably the distal end of the handle of a long-handled garden tool; is spaced apart from the center; and, is spaced apart from at least one of the other hollow sleeves.

In yet a further embodiment of the invention, I provide an improved tool storage receptacle for long-handled garden tools each including a handle having a distal end and a proximate end and a head connected to the proximate end. The tool storage receptacle includes a bottom ground engaging surface having a center; a circumferential wall extending upwardly from the bottom surface to circumscribe a hollow inner space; and, a plurality of hollow sleeves. Each hollow sleeve extends upwardly from the bottom surface; is sized to contact the distal end of the handle of a long-handled garden tool and support the tool in an upright orientation spaced apart from the handles of tools in other ones of the sleeves; is outside of and adjacent the circumferential wall to increase the structural integrity of the sleeve and to avoid reducing the volume of the inner space by placing the sleeves in the hollow inner space; is sized to receive slidably the distal end of the handle of a long handled tool; is spaced apart from the center; and, is spaced apart from at least one of the other hollow sleeves.

In yet still a further embodiment of the invention, I provide an improved tool storage stand for long-handled garden tools including a handle having a distal end and a proximate end, and a head connected to the proximate end. The improved the tool storage stand includes, in combination, a base having a height, a width, and a plurality of apertures each extending through the base and shaped and dimensioned to receive the distal end of the handle of only one long-handled garden tool and to support said handle in contact with the ground in an upright orientation spaced apart from handles in the other ones of the apertures; and, a plurality of long-handled garden tools each with the distal end inserted in and supported by one of the apertures and in contact with the ground. The ratio of the height of the base to the width of the base is in the range of 3.5:7 to 8:7.

In another embodiment of the invention, I provide an improved tool storage receptable. The tool receptable includes a plurality of long-handled garden tools each including a handle having a distal end and a proximate end, and a head attached to the proximate end of the handle; and, a storage unit setting on the ground. The storage unit includes a bottom surface for engaging the ground; a circumferential wall extending upwardly from the bottom surface; and, a plurality of hollow sleeves. Each sleeve extends upwardly from the bottom surface; is spaced apart from the center; is spaced apart from each of the other hollow sleeves; slidably receives the distal end of one of the long-handled garden tools; contacts the distal end and supports the handle of the one of the long-handled garden tools at an angle of from zero degrees to twenty-five degrees from the vertical in an upright orientation spaced apart from the handles of tools in other ones of said sleeves; and, is shaped and dimensioned such that the distal end extends completely through the sleeve and engages the ground, and the distal end leans against and frictionally engages a portion of the sleeve to generate a force pressing the tool receptacle against the ground.

In still a further embodiment of the invention, I provide an improved tool storage receptable for long-handled garden tools, each garden tool including a handle having a distal end and a proximate end, and a head connected to the proximate end. The tool storage receptable includes a bottom surface for engaging the ground and including a center; a circumferential wall extending upwardly from the bottom surface and having a height in the range of six to ten inches and a width in the range of five inches to twelve inches; and, a plurality of hollow sleeves. Each sleeve extends from the bottom surface; has a width in the range of one inch to two inches; slidably receives the distal end of the handle of a long-handled garden tool; contacts the distal end and supports the handle at an angle of from zero degrees to twenty-five degrees from the vertical in an upright orientation spaced apart from the handles of tools in other ones of the sleeves; perimts the distal end to extend completely through the sleeve and engage the ground; and, permits the distal end to lean against and frictionally engage a portion of the sleeve to generate a force pressing the tool receptacle against the ground; is spaced apart from the center; and, is spaced apart from at least one of the other hollow sleeves.

In still another embodiment of the invention, I provide an improved tool storage receptacle for long-handled garden tool, each garden tool including a handle having a distal end and a proximate end, and a head connected to the proximate end. The tool storage receptacle includes a bottom surface for engaging the ground and having a center; a circumferential wall extending upwardly from the bottom surface and having a width in the range of five inches to twelve inches; and, a plurality of hollow sleeves. Each sleeve extends upwardly from said bottom surface and has a height in the range of six to ten inches; has a width in the range of one inch to two inches; slidably receives the distal end of a long-handled garden tool; contacts the distal end and supports the handle at an angle of from zero degrees to twenty-five degrees from the vertical in an upright orientation spaced apart from the handles of tools in other ones of the sleeves; permits the distal end to extend completely through the sleeve and engage the ground; permits the distal end to lean against and frictionally engage a portion of the sleeve to generate a force pressing the tool receptacle against the ground; is spaced apart from the center; and, is spaced apart from at least one of the other hollow sleeves.

In another embodiment of the invention, I provide an improved tool storage receptacle. The tool receptacle includes a plurality of long-handled articles each including a handle having a distal end; and, a storage unit setting on the ground. The storage unit includes a bottom surface for engaging the ground; a circumferential wall extending upwardly from the bottom surface; and, a plurality of hollow sleeves. Each sleeve extends upwardly from the bottom surface; is spaced apart from the center; is spaced apart from each of the other hollow sleeves; slidably receives the distal end of one of the long-handled articles; contacts the distal end and supports the handle of the one of the long-handled articles at an angle of from zero degrees to twenty-five degrees from the vertical in an upright orientation spaced apart from the handles of articles in other ones of said sleeves; and, is shaped and dimensioned such that the distal end extends completely through the sleeve and engages the ground, and the distal end leans against and frictionally engages a portion of the sleeve to generate a force pressing the tool receptacle against the ground.

In still a further embodiment of the invention, I provide an improved tool storage receptacle for long-handled articles, each article including a handle having a distal end. The tool storage receptacle includes a bottom surface for engaging the ground and including a center; a circumferential wall extending upwardly from the bottom surface and having a height in the range of six to ten inches and a width in the range of five inches to twelve inches; and, a plurality of hollow sleeves. Each sleeve extends from the bottom surface; has a width in the range of one inch to two inches; slidably receives the distal end of the handle of a long-handled article; contacts the distal end and supports the handle at an angle of from zero degrees to twenty-five degrees from the vertical in an upright orientation spaced apart from the handles to articles in other ones of the sleeves; permits the distal end to extend completely through the sleeve and engage the ground; and, permits the distal end to lean against and frictionally engage a portion of the sleeve to generate a force pressing the tool receptacle against the ground; is spaced apart from the center; and, is spaced apart from at least one of the other hollow sleeves.

In still another embodiment of the invention, I provide an improved tool storage receptacle for long-handled articles, each article including a handle having a distal end. The tool storage receptacle includes a bottom surface for engaging the ground and having a center; a circumferential wall extending upwardly from the bottom surface and having a width in the range of five inches to twelve inches; and, a plurality of hollow sleeves. Each sleeve extends upwardly from said bottom surface and has a height in the range of six to ten inches; has a width in the range of one inch to two inches; slidably receives the distal end of a long-handled article; contacts the distal end and supports the handle at an angle of from zero degrees to twenty-five degrees from the vertical in an upright orientation spaced apart from the handles of articles in other ones of the sleeves; permits the distal end to extend completely through the sleeve and engage the ground; permits the distal end to lean against and frictionally engage a portion of the sleeve to generate a force pressing the tool receptacle against the ground; is spaced apart from the center; and, is spaced apart from at least one of the other hollow sleeves.

In yet still another embodiment of the invention, I provide an improved method for storing long-handled garden tools, each tool including a handle having a length, a distal end and a proximate end, and a head connected to the proximate end. The method includes the step of providing a stand. The stand has a height; a width; an upstanding wall having a top and circumscribing an inner space; a plurality of upstanding sleeve positioned outside of the inner space and outside and adjacent the circumferential wall and each shaped and dimensioned to receive the distal end of the handle of only one of the long-handled garden tools and support the handle in an upright orientation spaced apart from handles in the other ones of the apertures. The method also includes the steps of placing ballast in the inner space; and, inserting the distal end of each tool in a different one of the apertures.

Figure 4:
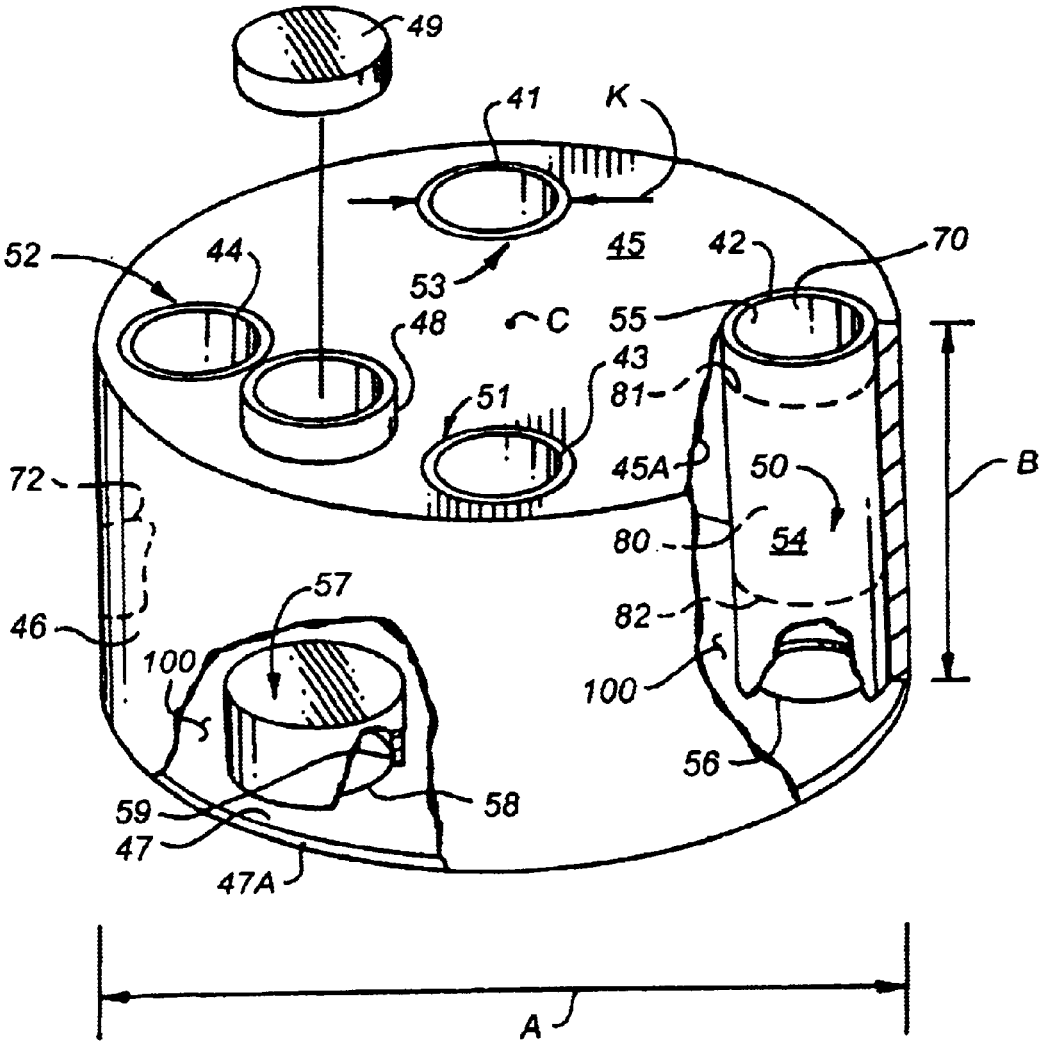
FIG. 4 is a perspective view further illustrating construction details of the tool storage stand of FIG. 3.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 3 and 4 illustrate a tool storage stand 40 constructed in accordance with the invention for long-handled garden tools. As used herein, a long-handled tool is a tool with a handle having a length in the range of forty-two inches to sixty-six inches. A garden tool is a tool normally utilized for out-of-doors yard work on the grounds around a residence. As used herein, yard work includes landscaping, gardening, lawn care, planting and care of trees and shrubs and other plants, building berms, building walkways and patios, and other work in the yard of a residence or other structure. By way of example, and not limitation, garden tools typically include shovels, rakes, hoes, and brooms. The method and apparatus of the invention are specifically utilized in conjunction with long-handled garden tools and, as such, are not intended to be practical for other kinds of tools. In particular, in order to provide an inconspicuous, compact method and apparatus for storing long-handled garden tools, the invention intentionally excludes both short tool and tools with unusually long handles. Hammers and other short tools are typically stored in a tool box. Tools with handles longer than sixty-six inches are awkward to manipulate and usually require special storage structures. The advantages of the invention which are found in conjunction with the storage of long-handled garden tools, likely are not apparent with respect to the storage of small tools and tools with unusually long handles. The invention is not intended for use in conjunction with such tools.

As used herein, a residence is a structure in which one or more individuals reside, eat, and sleep. The grounds of a residence comprises the lawn, walks, patios, gardens, swimming pools and other out-of-door areas normally found outside the enclosed residence structure in which individuals reside, eat, and sleep.

Each of the long-handled garden tools illustrated in FIG. 3 includes a handle having a distal end and a proximate end, and, includes a head attached to the proximate end of the handle. Hoe 14 includes handle 16 and head 17 attached to the proximate end of handle 16. Shovel 15 includes head 21 attached to the proximate end of handle 20. Broom 17 includes head 28 connected to the proximate end of handle 17. Rake 16 includes head 26 attached to the proximate end 25 of handle 24. The distal end of hoe 14 is slidably received by circular aperture or opening 42 in stand 40. The distal end of shovel 21 is slidably received by circular aperture or opening 43 in stand 40. The distal end of broom 17 is slidably received by circular aperture or opening 44 in stand 40. And, the distal end of rake 16 is slidably received by circular aperture or opening 41. Stand 40 includes circular top surface 45, cylindrical circumferential wall 46, and circular ground engaging bottom surface 47. Stand 40 is preferably fabricated from plastic or some other rust resistant material.

In FIG. 4, each hollow cylindrical sleeve 50 to 53 is of equivalent shape and dimension and extends from top surface 45 downwardly toward bottom surface 47. Each sleeve 50 to 53 has a circular opening 56 at the bottom of the sleeve, as well as a circular opening 50 to 53, as the case may be, at the top of the sleeve. The inner cylindrical wall 70 of each sleeve 50 to 53 interconnects the openings at the top and bottom of the sleeve. The circular opening 56 at the bottom of each sleeve 50 to 53 allows fluid to drain out the bottom of the sleeve. Each sleeve 50 to 53 is not in fluid communication with the hollow interior 100 of stand 40.

As used herein, the width of each sleeve 50 to 53 refers to the largest diameter tool handle the sleeve can slidably receive. The width of the sleeve is critical in the use of stand 40 to store long-handled garden tools. The width of each sleeve is in the range of one inch to one and one-half inches, plus or minus one-eighth of an inch, i.e., the one inch wide sleeve can be one inch plus or minus one-eighth of an inch wide, as can any other width in the range of one inch to one and one-half inches. As will be further described with reference to FIG. 6, the relationship of the width of each sleeve 50 to 53 to the height of the sleeve is critical in determining whether a tool placed in a sleeve 50 to 53 can tilt at a greater angle than is desired in the practice of the invention. The shape and dimension of each sleeve 50 can vary as desired.

Hollow neck 48 extends upwardly from top surface 45 and is closed with cap 49. If desired, neck 48 can be externally threaded to receive an internally threaded cap 49. Sand, water, anti-freeze, or other ballast is delivered under gravity to the hollow interior of stand 40 through neck 48. The specific gravity of the ballast is preferably 0.75 or greater. Stand 40 can be fabricated from any desired material but is presently preferably, with the exception of cap 49, a molded unitary plastic stand. Cap 49 is molded separately. When stand 40 is molded from plastic, the inner wall 70 usually tapers slightly from bottom to top (or vice versa) to facilitate removal of the stand from a mold.

Detent 57 is formed in the bottom surface 47 of stand 40 and includes a circular aperture 58 and inner cylindrical surface 59 shaped and dimensioned to slidably receive and interlock or interfit with the cap 49 or neck 48 of another stand 40. If desired, neck 48 can extend downwardly from surface 45 into stand 40 and cap 49 can be shaped and dimensioned to be flush with surface 45 after cap 49 is inserted in neck 48. In this case, detent 57 is not required to facilitate the stacking of one stand 40 on top of another stand 40.

Sleeves 50 to 53 are each located at the perimeter of stand 40 near circumferential wall 46. This positioning of sleeves 50 to 53, although not necessary, is important in the practice of the invention because it increases the structural integrity of stand 40, making it more resistant to lateral shear forces acting parallel to surfaces 45 and 47. If desired, each sleeve 50 to 53 can be connected to wall 46.

Sleeves 50 to 53 preferably are equally spaced from one another and each have an opposing sleeve on the opposite side of stand 40. When the handles of a pair of tools are each inserted in a different one of a pair of opposing sleeves 50–52 or 51–53, a counterbalancing is produced which enhances the stability of stand 40. When an even number of sleeves, each with an opposing sleeve on an opposite side of stand 40, is utilized, a symmetrical arrangement of sleeves 50 to 53 usually results. A central portion 80 (between dashed lines 81 and 82 in FIG. 4) of a sleeve 50 can be omitted during construction of a stand 40, or other selected portions of a sleeve 50 can be omitted. Even though such portions are omitted, the resulting structure is still termed herein a sleeve 50 to 53 as long as the resulting structure functions to support a tool handle in stand 40 in the desired orientation. An aperture formed through the top wall 45A or bottom wall 47A can comprise a sleeve.

In the event stand 40 is not hollow, but is a solid piece of material with sleeve openings drilled in the stand 40, a symmetrical arrangement of sleeve openings is still preferred. In the practice of the invention, cylindrical openings drilled in a solid piece of material are regarded as sleeves.

While openings 41 to 44 need not be circular, and while the inner surface 70 of each sleeve 50 to 53 need not be cylindrical, these shapes are preferred in the practice of the invention because the handles of tools are normally cylindrical in shape.

Figure 6:
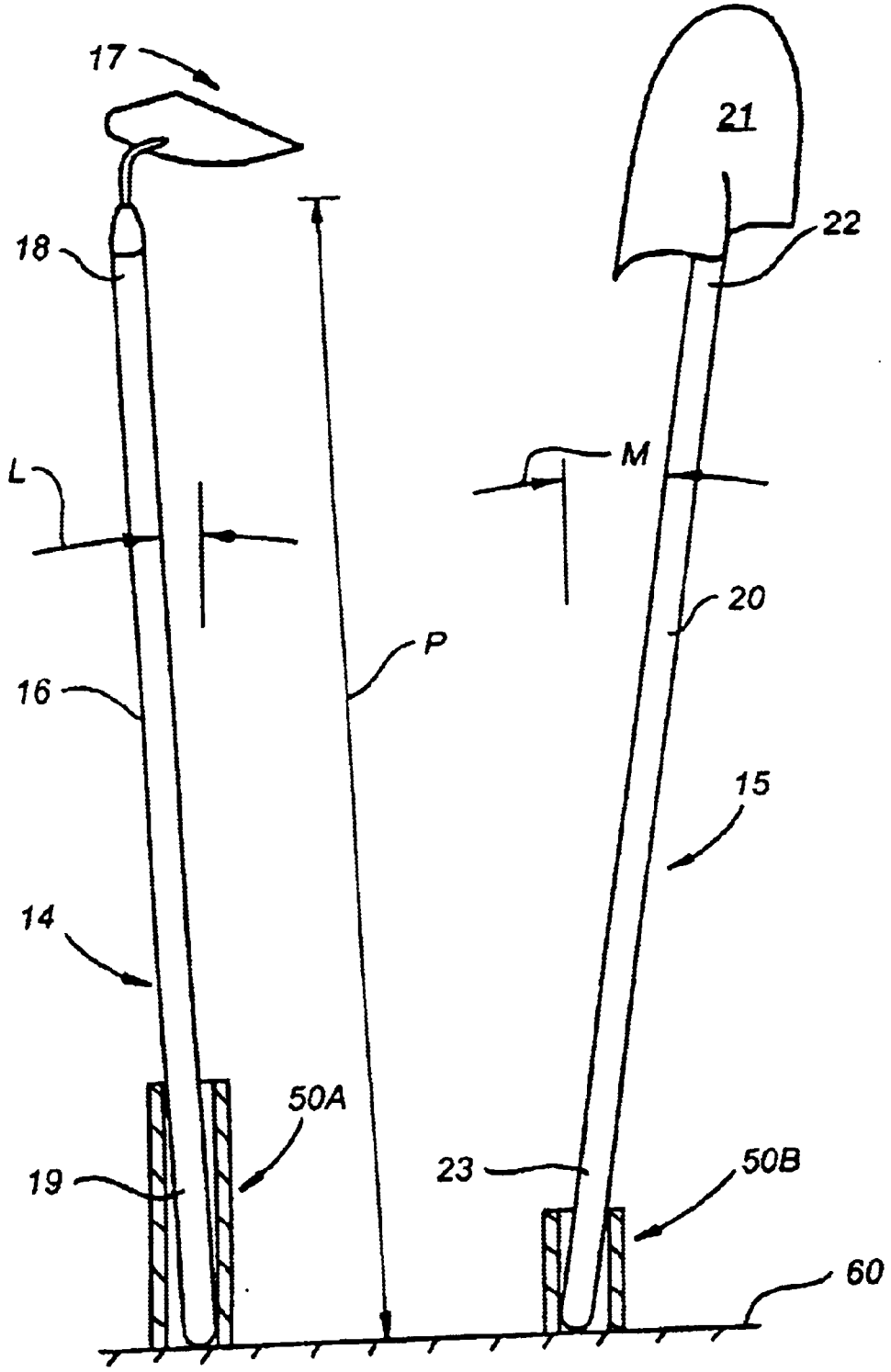
FIG. 6 is a side elevation view illustrating the affect of the height of the storage stand sleeve on the orientation of a long-handled garden tool stored in the storage stand.

The height, indicated by arrow B in FIG. 4, of wall 46 and of each sleeve 50 to 53 is critical in the practice of the invention. The height of each sleeve 50 to 53 is preferably in the range of six to eight inches. When the height exceeds eight inches, the appearance of stand 40 looks too bulky. The height cannot be less than about six inches. As shown in FIG. 6, as the height of a sleeve 50A, 50B decreases, a tool which is placed in the sleeve tilts more. Accordingly, in FIG. 6 the shovel 15 in sleeve 50B tilts more than the hoe 14 in sleeve 50A. It is desirable that the angle L, M that a tool tilts from the vertical be in the range of zero degrees to twenty-five degrees, preferably zero degrees to fifteen degrees. When a long-handled garden tools tilts through an angle of greater than twenty-five degrees, there is an increased risk that stand 40 may tilt. This risk can be offset by adding heavier ballast or by making the stand 40 larger. Adding more ballast or making the stand larger are particularly undesirable because they make use of the invention impractical and undesirable. If the stand is larger, as are some prior art stands, it is difficult to move the stand and find convenient places in a residence to place the stand. If the ballast is too heavy, as is the case with some prior art stands, it is also difficult to move the stand.

The width, indicated by arrow K, of each sleeve is also critical in the practice of the invention because the width contributes to the amount that a garden tool tilts when the distal end of the tool handle is inserted in a sleeve 50 to 53. The diameter of the handle of most garden tools is in the range of one inch to one and one-half inches. Width K is, as noted, preferably in the range of one inch to one and one-half inches.

The width of stand 40, indicated by arrow A in FIG. 4, is also critical in the practice of the invention, as is the relationship between the width of stand 40 and the height of stand 40, the width of stand 40 and length of the handle of each garden tool, the height of stand 40 and the length of the handle of each tool, and the length of the handle of each tool and the width of each sleeve 50 to 53.

The width A is in the range of seven to twelve inches, preferably eight to ten inches, plus or minus one-eighth of an inch. Decreasing the width of stand 40 to less than seven inches is not desired, or practical, because the stand is too unstable and because long-handled garden tools are too closely bunched. Increasing the width of stand 40 to more than twelve inches makes the stand impractical to use in the same manner as large prior art stands. Larger stands require too much space, too much weight, and too much strength to move.

Figure 5:
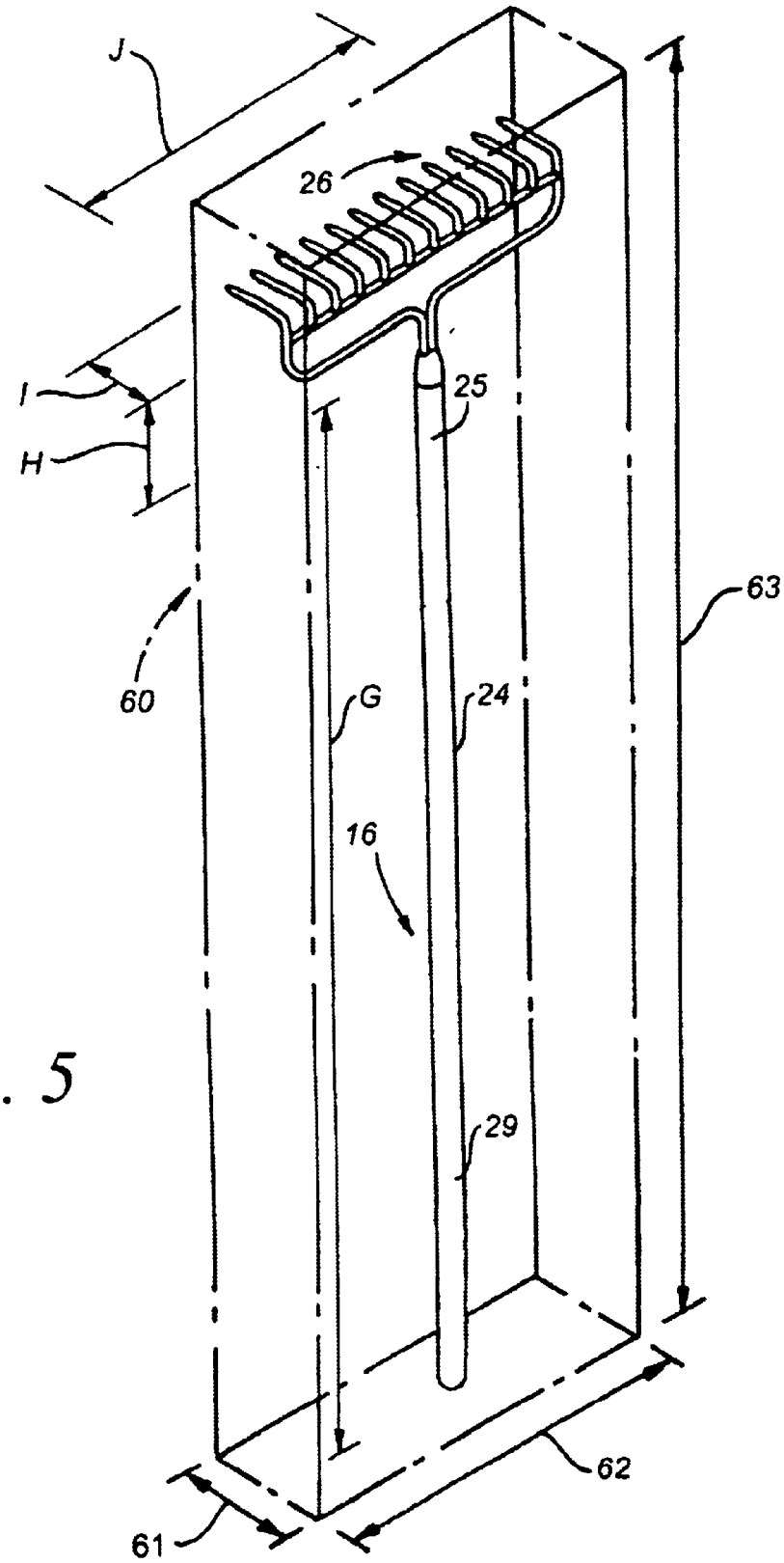
FIG. 5 is a perspective view illustrating the envelope of long-handled garden tools store in accordance with the method and apparatus of the invention.

Long-handled garden tools used in the practice of the invention must fit into a size envelope 60 illustrated in FIG. 5. Envelope 60 has a length indicated by arrows 63, width indicated by arrows 62, and depth indicated by arrows 61. As earlier noted, the length of the handle of a long-handled garden tool is in the range of forty-two to sixty-six inches. The length G of the handle of a rake 16 of the type illustrated in FIG. 5 is typically sixty inches. The length of the handle 20 of a shovel 15 of the type illustrated in FIG. 3 is typically about forty-eight inches. The length of the handle of a broom 17 of the type illustrated in FIG. 3 is typically about forty-five inches. The length, indicated by arrows P in FIG. 6, of the handle 16 of a hoe 14 of the type illustrated in FIGS. 3 and 6 is typically about sixty inches.

Long-handled garden tools have a head, the length of which is typically in the range of six to twenty-four inches. The length, indicated by arrows H in FIG. 5, of the head 26 of rake 16 is about nine inches. The length, indicated by arrows C in FIG. 3, of the head 28 of broom 17 is about twelve inches. The length of the head 21 of shovel 15 is about eleven inches.

The length 63 of envelope 60 is ninety inches, which means that the length of a garden tool, including the handle and head, must be no greater than ninety inches in the practice of the invention.

The head of long-handled garden tools has a depth which is relatively small and ordinarily is in the range of one to ten inches. The head 26 of rake 16 has a depth, indicated by arrows I in FIG. 5, of about three and one-half inches. The head 17 of hoe 14 has a depth, indicated by arrows E in FIG. 3, of about eight inches. The head 21 of shovel 15 has a depth of about four and one-half inches. The head 28 of broom 17 has a depth of about two inches. Consequently, the depth, indicated by arrows 61 in FIG. 5, of envelope 60 is ten inches in the practice of the invention.

The width of the head of a long-handled garden tool is typically in the range of four inches to thirty inches. The width, indicated by arrows J in FIG. 5, of the head 26 of rake 16 is typically about sixteen inches. The width, indicated by arrows F in FIG. 3, of the head 17 of hoe 14 is typically about eight inches. The width of head 21 of shovel 15 is typically about nine inches. The width of the head 28 of broom 17 is typically about ten inches. Consequently, the width, indicated by arrows 62 in FIG. 5, of envelope 60 is thirty inches.

In the practice of the invention, a long-handled garden tool preferably, although not necessarily, must fit in the envelope 60.

The critical relationships between the various required dimensions for the length of the handle of a tool and for the stand 40 can be set forth in proportional relationships.

The proportional relationship of the height of stand 40 to the width of stand 40 is in the range of 3.5:7 to 8:7. For example, if the height of stand 40 is six inches and the width is ten inches, the proportional relationship between the height and the width is about 4.2 to 7, which is within the range of 3.5:7 to 8:7.

The proportional relationship of the length of the handle of a garden tool to the width of stand 40 is in the range of 7:2 to 19:2. For example, if the length of the handle of a garden tool is fifty-six inches and the width of stand 40 is ten inches, the proportional relationship between the length of the handle of the garden tool to the width of stand 40 is about 11:2, which is in the range of 7:2 to 19:2.

The proportional relationship of the length of the handle of a garden tool to the height of stand 40 or a sleeve 50 to 53 is in the range 22:2 to 11:2. For example, if the length of the handle of a garden tool is sixty inches and the height of stand 40 or a sleeve 50 to 53 is six inches, the proportional relationship between the length of the handle of the tool and the height of stand 40 or sleeve 50 to 53 is 20:2, which is in the range of 22:2 to 11:2.

Figure 7A:
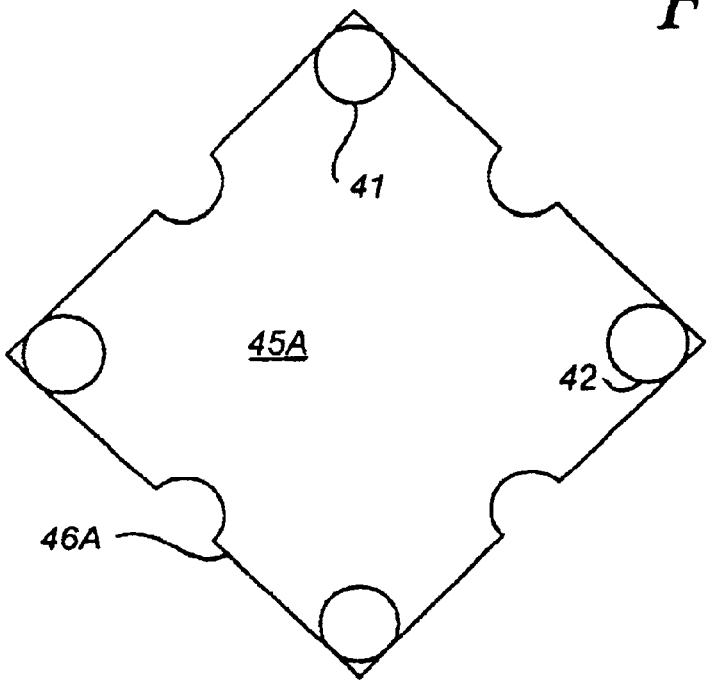
FIGS. 7A to 7F are top views illustrating alternate embodiments of the tool stand of the invention.
Figure 7B:
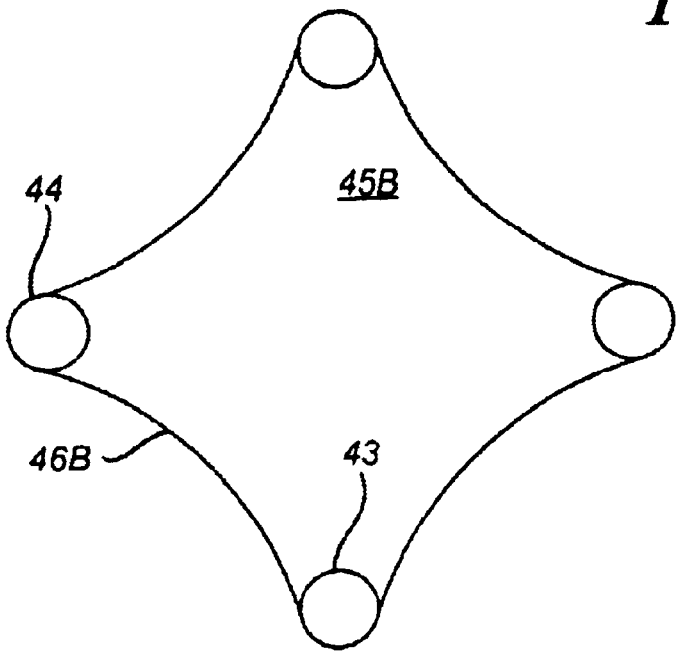
Figure 7C:
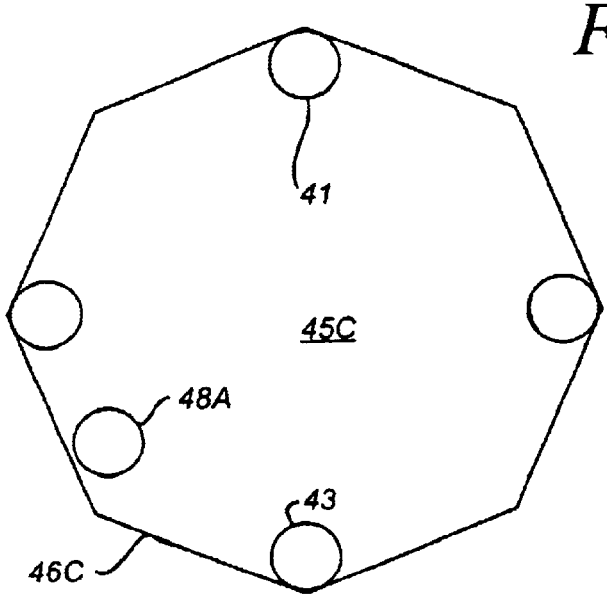
Figure 7D:
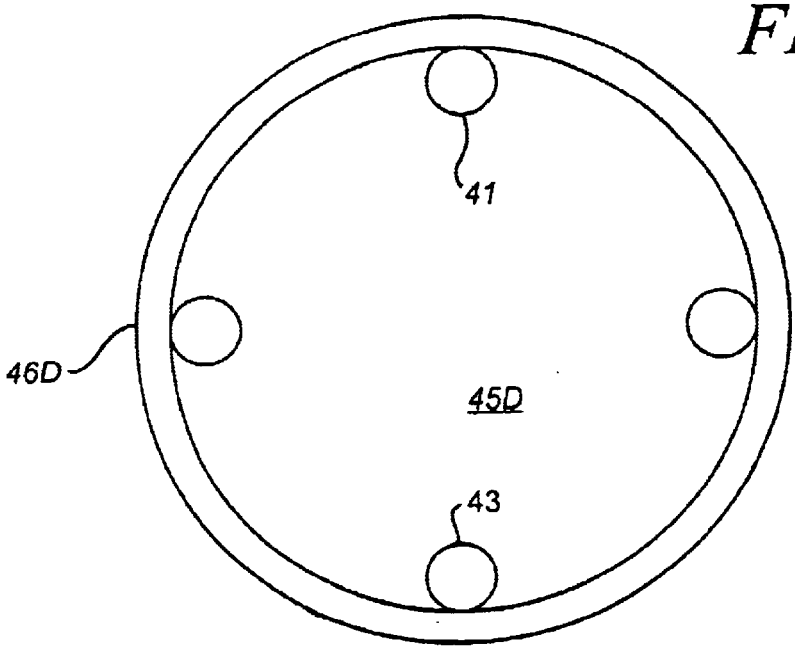
Figure 7E:
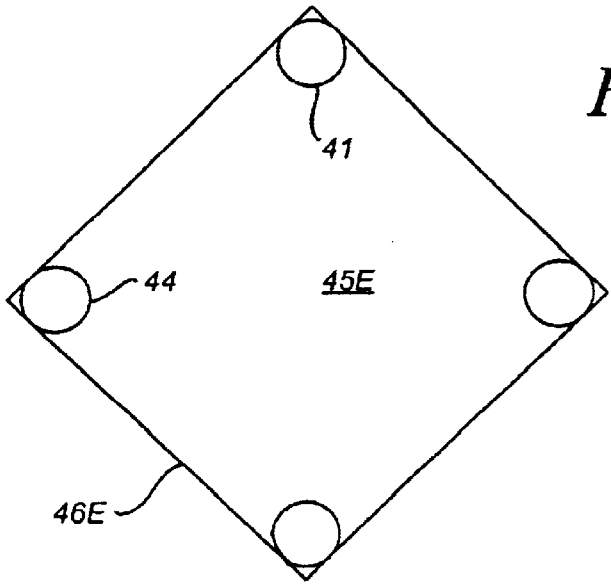
Figure 7F:
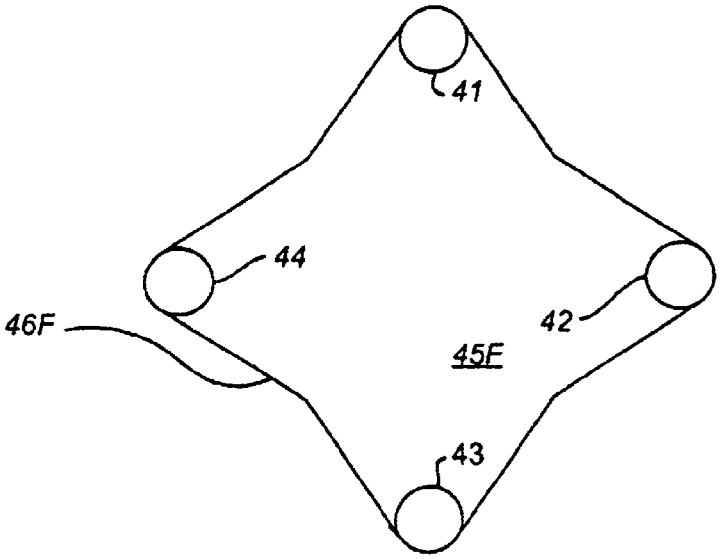

FIGS. 7A to 7F are top views illustrating alternate embodiments of the stand of the invention in which the circumferential wall has a different shape and dimension. FIG. 7A illustrates top surface 45A and circumferential wall 46A; FIG. 7B illustrates top surface 45B and circumferential wall 46B; FIG. 7C illustrates top surface 45C and circumferential wall 46C; FIG. 7D illustrates top surface 45D and circumferential wall 7D; FIG. 7E illustrates top surface 45E and circumferential wall 46E; and, FIG. 7F illustrates top surface 45F and circumferential wall 46F. FIG. 7C also illustrates an alternate position on top surface 45C for a hollow neck 48A.

Stand 40 can be provided with indents 72 (FIG. 4) which serve as handles, or can be otherwise provided with a handle or handles which facilitate the lifting and transport of stand 40.

In use, about one gallon of water (sixteen pounds) or other material is poured through neck 48 into stand 40 to serve as ballast. The distal ends of long-handled tools are inserted through openings 41 to 44. Each distal end extends completely through a sleeve 50 to 53 and contacts the ground on which stand 40 is resting. As used here, the term ground refers to the earth, a floor, a table top, or other support surface on which stand 40 rests.

The weight of ballast inserted in stand 40 can vary as desired. From ten to twenty pounds of ballast is desired, however, to insure that stand 40 can be readily moved without undue exertion by a person of average strength and dexterity.

Figure 8:
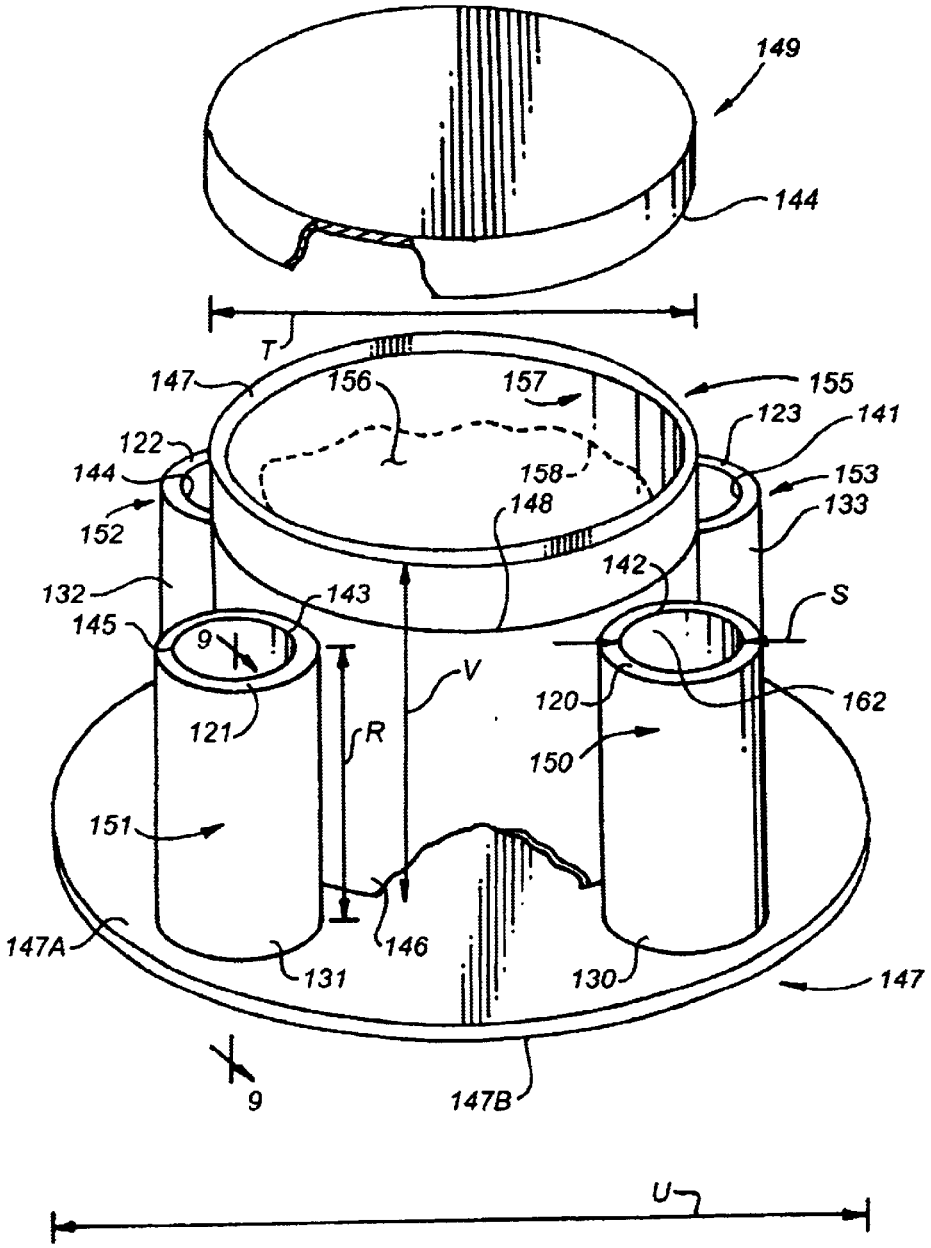
FIG. 8 is a perspective view illustrating a tool storage stand constructed in accordance with an alternate embodiment of the invention; and, FIG. 9 is a section view of the stand of FIG. 8 taken along section line 9—9 thereof and illustrating further construction details thereof.
Figure 9:
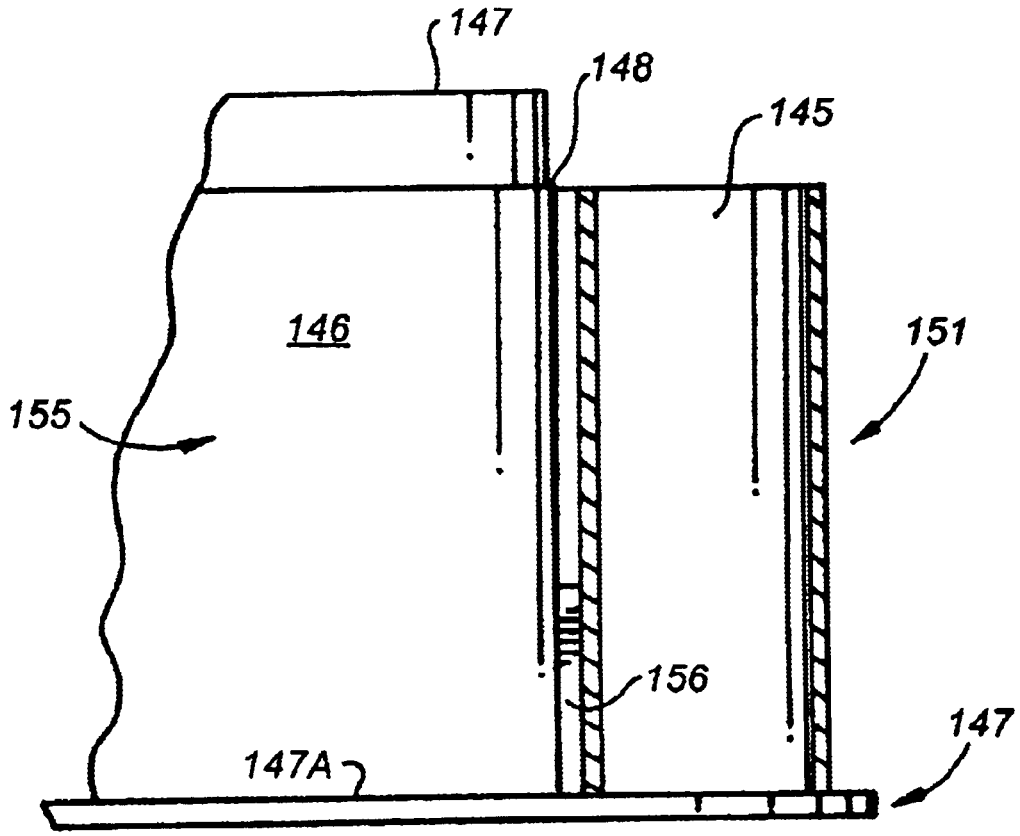

An alternate embodiment of the invention is illustrated in FIGS. 8 and 9 and is also used in conjunction with the long-handled garden tools that are illustrated in FIG. 3 and are described above. For example, the distal end of hoe 14 can be slidably received by circular aperture or opening 142 in stand 155 in FIG. 8. The distal end of shovel 21 can be slidably received by circular aperture or opening 143 in stand 155 in FIG. 8. The distal end of broom 17 can be slidably received by circular aperture or opening 144 in stand 155. And, the distal end of rake 16 can be slidably received by circular aperture or opening 141 in stand 155. Stand 155 includes cylindrical upstanding circumferential wall 157 circumscribing cylindrical inner space 156, includes circular ground engaging bottom 147 with upper surface 147A and bottom surface 147B adjacent and contacting the ground. Bottom 147 (or 47A) can be mounted on ground engaging wheels or another ground engaging structure and be spaced apart from, but still adjacent, the ground. Wall 157 includes outer cylindrical surface 146. Hollow cylindrical sleeves 150 to 153 extend upwardly from bottom 147. Ballast 158 can be placed in space 156 to provide weight to stabilize stand 155. In FIG. 8, the bottom end of each sleeve 150 to 153 contacts or is integrally formed with bottom 147. As shown in FIG. 9, a sleeve 151 can be secured to wall 157 with plastic, adhesive or some other bridging material 156. When a sleeve 151 is secured to wall 157, or possibly lid 149, it is not necessary for the bottom of a sleeve 151 to contact bottom 147. The bottom of the sleeve 151 can be spaced upwardly apart from bottom 147. If a sleeve 151 is positioned above and spaced apart from bottom 147, it still extends upwardly from bottom 147 even though the sleeve does not contact bottom 147. Stand 155 is preferably fabricated from plastic or some other rust resistant material, but the material utilized can vary as desired. Bottom 147 and surfaces 147A and 147B have a center point equivalent to the center point of a circle having the diameter indicated by arrows U. The shape and dimension of bottom 147 can vary as desired. If the shape of bottom 147 is not symmetrical, the center is approximated. The center normally will lie at some point within the outer edge of bottom 147.

In FIG. 8, each hollow cylindrical sleeve 150 to 153 is of equivalent shape and dimension and extends upwardly from bottom 147. Each sleeve 150 to 153 preferably, but not necessarily, has an opening at the bottom of the sleeve that extends through base 147 in the same manner that each sleeve in FIG. 3 has an opening 56 extending through bottom 47A. Each sleeve 150 to 153 also has a circular opening 141 to 144, as the case may be, at the top of the sleeve. The inner cylindrical wall 162 of a sleeve 150 interconnects the openings at the top and bottom of the sleeve. The circular opening that is at the bottom of a sleeve and extends through base 147 permits fluid to drain out the bottom of the sleeve. Each sleeve is preferably, but not necessarily, not in fluid communication with space 156.

As used herein, the width of each sleeve 150 to 153 refers to the largest diameter tool handle the sleeve can slidably receive. The width of the sleeve is critical in the use of stand 155 to store long-handled garden tools. The width of each sleeve is in the range of one inch to two inches, plus or minus one-eighth of an inch, i.e., the one inch wide sleeve can be one inch plus or minus one-eighth of an inch wide, as can any other width in the range of one inch to two inches. The relationship of the width of each sleeve 150 to 153 to the height of the sleeve is critical in determining whether a tool placed in a sleeve 150 to 153 can tilt at a greater angle than is desired in the practice of the invention. This relationship is earlier described with reference to FIG. 6. The shape and dimension of each sleeve 150 to 153 can vary as desired.

Sleeves 150 to 153 are each located at the perimeter of stand 155 outside of circumferential wall 157. Sleeves 150 to 153 are positioned outside of wall 157 to avoid having sleeves 50 to 53 occupy a portion of space 156. Sleeves 150 to 153 can be positioned away from wall 157, but preferably are adjacent wall 157 to increase the structural strength and integrity of stand 155. As earlier noted and illustrated in FIG. 9, each sleeve 150 can be secured to wall 157 with a bridge 156 constructed from adhesive, solder, plastic, or some other desired material. Or, if stand 155 is molded, a portion of the side of a sleeve 150 can be integrally formed with wall 157. The positioning of sleeves 150 to 153 adjacent wall 157, although not necessary, is important in the practice of the invention because it increases the structural integrity of stand 155, making it more resistant to lateral shear forces acting parallel to surfaces 147A and 147B. If desired, each sleeve 50 to 53 can be connected to wall 157.

Sleeves 150 to 153 preferably are equally spaced from one another and each have an opposing sleeve on the opposite side of stand 155. Sleeves 150 to 153 can be adjacent or contacting one another. When the handles of a pair of tools are each inserted in a different one of a pair of opposing sleeves 150–152 or 151–153, a counterbalancing is produced which enhances the stability of stand 40. When an even number of sleeves, each with an opposing sleeve on an opposite side of stand 155, is utilized, a symmetrical arrangement of sleeves 150 to 153 usually results. A central portion of a sleeve 150 can be omitted during construction of a stand 155, or other selected portions of a sleeve 150 can be omitted. Even though such portions are omitted, the resulting structure is still termed herein a sleeve 150 to 153 as long as the resulting structure functions to support a tool handle in stand 155 in the desired orientation. An aperture formed through bottom 147 can comprise a sleeve.

In the event stand 155 is not hollow, but is a solid piece of material with sleeve openings drilled or otherwise formed in the stand 155, a symmetrical arrangement of sleeve openings is still preferred. In the practice of the invention, cylindrical openings drilled or otherwise formed in a solid piece of material are regarded as sleeves.

While openings 141 to 144 need not be circular, and while the inner surface 162 of each sleeve 150 to 153 need not be cylindrical, these shapes are preferred in the practice of the invention because the handles of tools are normally cylindrical in shape.

The height, indicated by arrows R in FIG. 8, of each sleeve 150 to 153 and the height, indicated by arrows V, of wall 147 are critical in the practice of the invention. The height of each sleeve 150 to 153 is preferably in the range of six to ten inches. When the height exceeds ten inches, the appearance of stand 155 looks too bulky. The height cannot be less than about six inches. As shown in FIG. 6, as the height of a sleeve 50A, 50B (or a sleeve 150, 151, etc.) decreases, a tool which is placed in the sleeve tilts more. Accordingly, in FIG. 6 the shovel 15 in sleeve 50B tilts more than the hoe 14 in sleeve 50A. It is desirable that the angle L, M that a tool tilts from the vertical be in the range of zero degrees to twenty-five degrees, preferably zero degrees to fifteen degrees. When a long-handled garden tools tilts through an angle of greater than twenty-five degrees, there is an increased risk that stand 155 may tilt. This risk can be offset by adding heavier ballast or by making the stand 155 larger. Adding more ballast or making the stand larger are particularly undesirable because they tend to make use of the invention impractical. If the stand is larger, as are some prior art stands, it is difficult to move the stand and find convenient places in a residence to place the stand. If the ballast is too heavy, as is the case with some prior art stands, it is also difficult to move the stand. The height, indicated by arrows V, of wall 147 is preferably in the range of six to ten inches.

The width, indicated by arrow S, of the opening in each sleeve is also critical in the practice of the invention because the width contributes to the amount that a garden tool tilts when the distal end of the tool handle is inserted in a sleeve 150 to 153. The diameter of the handle of most garden tools is in the range of one inch to two inches. Width S is, as noted, preferably in the range of one inch to two inches.

The width of stand 155, indicated by arrow U in FIG. 8,is also critical in the practice of the invention, as is the relationship between the width of stand 155 and the height of stand 155, the width of stand 155 and length of the handle of each garden tool, the height of stand 155 and the length of the handle of each tool, and the length of the handle of each tool and the width of each sleeve 150 to 153.

The width U is in the range of seven to fourteen inches, preferably eight to twelve inches, most preferably eight to ten inches, plus or minus one-eighth of an inch. Decreasing the width of stand 155 to less than seven inches is not desired, or practical, because the stand is too unstable and because long-handled garden tools are too closely bunched. Increasing the width of stand 155 to more than fourteen inches makes the stand impractical to use in the same manner as large prior art stands. Larger stands require too much space, too much weight, and too much strength to move. The "open" space intermediate sleeves 150 to 153 in the embodiment of the invention of FIGS. 8 and 9 permits the width U to be somewhat larger because the embodiment of the invention in FIGS. 8 and 9 usually looks smaller to an observer than does the embodiment of the invention in FIG. 4. The maximum diameter or width T of wall 147 typically is at least one to two inches less than the width U of stand 155, this to leave sufficient perimeter space on bottom 147 for sleeves 150 to 153. Width T is in the range of five to thirteen inches, preferably six to twelve inches, most preferably eight to ten inches.

As earlier described, long-handled garden tools used in the practice of the invention preferably, but not necessarily, must fit into a size envelope 60 illustrated in FIG. 5.

The critical relationships between the various required dimensions for the length of the handle of a tool and for the stand 155 can be set forth in proportional relationships.

The proportional relationship of the height of stand 155 to the width of stand 155 is in the range of 3.5:7 to 8:7. For example, if the height of stand 155 is six inches and the width is ten inches, the proportional relationship between the height and the width is about 4.2 to 7, which is within the range of 3.5:7 to 8:7.

The proportional relationship of the length of the handle of a garden tool to the width of stand 155 is in the range of 7:2 to 19:2. For example, if the length of the handle of a garden tool is fifty-six inches and the width of stand 155 is ten inches, the proportional relationship between the length of the handle of the garden tool to the width of stand 155 is about 11:2, which is in the range of 7:2 to 19:2.

The proportional relationship of the length of the handle of a garden tool to the height of stand 155 or a sleeve 150 to 153 is in the range 22:2 to 11:2. For example, if the length of the handle of a garden tool is sixty inches and the height of stand 155 or a sleeve 150 to 153 is six inches, the proportional relationship between the length of the handle of the tool and the height of stand 155 or sleeve 150 to 153 is 20:2, which is in the range of 22:2 to 11:2.

The shape of wall 147 can vary in the manner illustrated by circumferential walls 46A to 46F in FIGS. 7A to 7E and can take on any desired shape and dimension.

Stand 155 can be provided with indents which serve as handles, or can be otherwise provided with a handle or handles which facilitate the lifting and transport of stand 155.

In use, about one gallon of water (sixteen pounds) or a desired amount of another material is placed in space 156 of stand 155 to serve as ballast. Lid 149 is placed over edge 147 until lower edge 144 contacts circumferential lips 148 formed in wall 147. The distal ends of long-handled tools are inserted through openings 141 to 144. Each distal end extends completely through a sleeve 150 to 153 and contacts the ground on which stand 155 is resting. As used here, the term ground refers to the earth, a floor, a table top, or other support surface on which stand 155 rests.

The weight of ballast inserted in stand 155 can vary as desired. From ten to twenty pounds of ballast is desired, however, to insure that stand 155 can be readily moved without undue exertion by a person of average strength and dexterity.

Mops, fishing rods and other tools or articles having an overall length comparable to that of a long-handled garden tool and fitting in envelope 60 can be utilized in the invention. Such other tools and articles having a length comparable to that of a long-handled tool and fitting in envelope 60 are termed long-handled articles herein. Long-handled garden tools are also long-handled articles.

Having described my invention in such terms as to enable those of skill in the art to make and practice it, and having described the presently preferred embodiments thereof, I claim:

1. A tool storage stand comprising, in combination, (a) a plurality of long-handled garden tools each including a handle having a distal end and a proximate end, and a head attached to the proximate end of the handle;

(b) a base including a bottom surface for positioning adjacent the ground and a perimeter extending upwardly from the bottom surface; and, (c) a plurality of apertures in the base each extending through the base, adjacent the perimeter of the base, and slidably rec&ving said distal end of said handle of one of said toots and supporting said distal end in contact with the ground and in an upright orientation spaced apart from said handles of said tools in the other ones of said apertures.

2. A method of storing in a residence including outer grounds and using a plurality of long-handled garden tools each having a handle with a distal end and a proximate end, and a head connected to the proximate end, the method comprising the steps of (a) providing in the residence a support member having a center, a perimeter, at least a pair of opposing sides spaced apart from and bracketing said center, and at least a pair of vertically oriented apertures each formed through the support member at said perimeter on one of the sides opposite that of the other one of the apertures and shaped and dimensioned to receive and contact the distal end of a handle of a tool and support the distal end in contact with the ground to support and maintain the handle in a substantially vertical orientation spaced apart from handles in the other ones of the apertures;

(b) inserting for temporary storage the distal end of the handle of each long-handled garden tool in a support member in a different one of the vertically oriented apertures such that each pair of handles is in a different one of the pair of apertures; and, (c) removing each tool from the support member and using the tool during yard work in the outer grounds of the residence.

3. A tool storage receptacle for long-handled garden tools each including a handle having a distal end and a proximate end, and a head connected to the proximate end, the tool storage receptacle comprising (a) a bottom surface for positioning adjacent the ground and having a center;

(c) a circumferential wall extending upwardly from said bottom surface; and, (d) a plurality of hollow sleeves each (i) extending upwardly from said bottom surface, (ii) sized to contact the distal end of the handle of a long-handled garden tool and support the tool in an upright orientation spaced apart from the handles of tools in other ones of said sleeves, (iii) outside and adjacent said circumferential wall to increase the structural integrity of said sleeve, (iv) sized to receive slidably the distal end of the handle of a long-handled garden tool, (v) spaced apart from said center, (vi) spaced apart from at least one of said other ones of said hollow sleeves, and (vii) opening through said bottom to permit the distal end of the handle of a long-handled tool to contact the ground.

4. A tool storage stand for long-handled garden tools including a handle having a distal end and a proximate end, and a head connected to the proximate end, the tool storage stand comprising, in combination, (a) a base having a height, a width, and a plurality of apertures each extending through said base and shaped and dimensioned to receive the distal end of the handle of only one long-handled garden tool and support the distal end of the handle in contact with the ground and in an upright orientation spaced apart from handles in the other ones of said apertures; and, (b) a plurality of long-handled garden tools each with the distal end inserted in and supported by one of the apertures and in contact with the ground;

the ratio of the height of the base to the width of the base being in the range of 3.5:7 to 8:7.

5. A tool storage receptacle comprising (a) a plurality of long-handled garden tools each including a handle having a distal end and a proximate end, and a head attached to the proximate end of the handle;

(b) a storage unit setting on the ground and including (i) a bottom surface for positioning adjacent the ground and having a center;

(ii) a circumferential wall extending upwardly from said bottom surface; and, (iii) a plurality of hollow sleeves each extending upwardly from said bottom surface, spaced apart from said center, spaced apart from at least one of said other hollow sleeves, and slidably receiving said distal end of one of said long-handled garden tools, contacting said distal end and supporting said handle of said one of said long-handled garden toois at an angle of from zero degrees to twenty-five degrees from the vertical in an upright orientation spaced apart from said handles of said tools in other ones of said sleeves, shaped and dimensioned such that said distal end extends completely through the sleeve and engages the ground, and said distal end leans against and frictionally engages a portion of the sleeve to generate a force pressing the tool receptacle against the ground.

6. A tool storage receptacle for long-handled garden tools, each garden tool including a handle having a distal end and a proximate end, and a head connected to the proximate end, the tool storage receptacle comprising (a) a bottom surface for positioning adjacent the ground and having a center;

(b) a circumferential wall extending upwardly from said bottom surface and having a height in the range of six to ten inches and a width in the range of five inches to twelve inches; and, (c) a pluralty of hollow sleeves each (i) extending from said bottom surface, (ii) having a width in the range of one inch to two inches and slidably receiving the distal end of the handle of a long-handled garden tool, contacting the distal end and supporting the handle at an angle of from zero degrees to twenty-five degrees from the vertical in an uprtght orientation spaced apart from the handles of tools in other ones of the sleeves, permitting the distal end to extend completely through the sleeve and engage the ground, and permitting the distal end to lean against and frictionally engage a portion of the sleeve to generate a force pressing the tool receptacle against the ground, (iii) spaced apart from said center, and (iv) spaced apart from at least one of said other hollow sleeves.

7. A tool storage receptacle for long-handled garden tools, each garden tool including a handle having a distal end and a proximate end, and a head connected to the proximate end, the tool storage receptacle comprising (a) a bottom surface for positioning adjacent the ground and having a center;

(b) a circumferential wall extending upwardly from said bottom surface and having a width in the range of five inches to twelve inches;

(c) a plurality of hollow sleeves each (i) extending upwardly from said bottom surface and having a height in the range of six to ten inches, (ii) having a width in the range of one inch to two inches and slidably receiving the distal end of a long-handled garden tool, contacting the distal end and supporting the handle at an angle of from zero degrees to twenty-five degrees from the vertical in an upright orientation spaced apart from the handles of tools in other ones of the sleeves, permitting the distal end to extend completely through the sleeve and engage the ground, and permitting the distal end to lean against and frictionally engage a portion of the sleeve to generate a force pressing the tool receptacle against the ground, (iii) spaced apart from said center, and (iv) spaced apart from at least one said other hollow sleeves.

8. A tool storage receptable comprising (a) a plurality of long-handled articles each including a handle having a distal end;

(b) a storage unit setting on the ground and including (i) a bottom surface for positioning adjacent the ground and having a center;

(ii) a circumferential wall extending upwardly from said bottom surface; and, (iii) a plurality of hollow sleeves each
extending upwardly from said bottom surface,
spaced apart from said center,
spaced apart from at least one of said other hollow sleeves, and
slidably receiving said distal end of one of said long-handled articles,
contacting said distal end and supporting said handle of said one of said long-handled articles at an angle of from zero degrees to twenty-five degrees from the vertical in an upright orientation spaced apart from said handles of said articles in other ones of said sleeves,
shaped and dimensioned such that
said distal end extends completely through the sleeve and engages the ground, and
said distal end leans against and frictionally engages a portion of the sleeve to generate a force pressing the tool receptacle against the ground.

9. A tool storage receptacle for long-handled articles, each article including a handle having a distal end, the tool storage receptacle comprising (a) a bottom surface for positioning adjacent the ground and having a center;

(b) a circumferential wall extending upwardly from said bottom surface and having a height in the range of six to ten inches and a width in the range of five inches to twelve inches; and, (c) a plurality of hollow sleeves each (i) extending from said bottom surface, (ii) having a width in the range of one inch to two inches and
slidably receiving the distal end of the handle of a long-handled article,
contacting the distal end and supporting the handle at an angle of from zero degrees to twenty-five degrees from the vertical in an upright orientation spaced apart from the handles of articles in other ones of the sleeves,
permitting the distal end to extend completely through the sleeve and engage the ground, and
permitting the distal end to lean against and frictionally engage a portion of the sleeve to generate a force pressing the tool receptacle against the ground, (iii) spaced apart from said center, and (iv) spaced apart from at least one of said other hollow sleeves.

10. A tool storage receptacle for long-handled articles tools, each article including a handle having a distal end, the tool storage receptacle comprising (a) a bottom surface for positioning adjacent the ground and having a center;

(b) a circumferential wall extending upwardly from said bottom surface and having a width in the range of five inches to twelve inches;

(c) a plurality of hollow sleeves each (i) extending upwardly from said bottom surface and having a height in the range of six to ten inches, (ii) having a width in the range of one inch to two inches and
slidably receiving the distal end of a long-handled article,
contacting the distal end and supporting the handle at an angle of from zero degrees to twenty-five degrees from the vertical in an upright orientation spaced apart from the handles of articles in other ones of the sleeves,
permitting the distal end to extend completely through the sleeve and engage the ground, and
permitting the distal end to lean against and frictionally engage a portion of the sleeve to generate a force pressing the tool receptacle against the ground, (iii) spaced apart from said center, and (iv) spaced apart from at least one said other hollow sleeves.

* * * * *